US009546036B2

(12) United States Patent
Paulson et al.

(10) Patent No.: US 9,546,036 B2
(45) Date of Patent: Jan. 17, 2017

(54) METHOD AND SYSTEM TO WHITEN A GOLF HOLE

(71) Applicant: Par Aide Products Co., Lino Lakes, MN (US)

(72) Inventors: Randy Paulson, Maple Grove, MN (US); Eric R. Amato, Leverett, MA (US); Ronald W. Rzeszutek, Easthampton, MA (US)

(73) Assignee: Par Aide Products Co., Lino Lakes, MN (US)

( * ) Notice: Subject to any disclaimer, the term of this patent is extended or adjusted under 35 U.S.C. 154(b) by 0 days.

(21) Appl. No.: 14/691,089

(22) Filed: Apr. 20, 2015

(65) Prior Publication Data

US 2015/0232257 A1 Aug. 20, 2015

Related U.S. Application Data

(63) Continuation of application No. 13/577,593, filed as application No. PCT/US2011/000228 on Feb. 8, 2011, now Pat. No. 9,010,271.

(60) Provisional application No. 61/302,351, filed on Feb. 8, 2010.

(51) Int. Cl.

| | |
|---|---|
| ***B05B 1/26*** | (2006.01) |
| ***B05B 15/04*** | (2006.01) |
| ***B05D 1/02*** | (2006.01) |
| ***B05D 1/32*** | (2006.01) |
| ***B65D 83/16*** | (2006.01) |
| ***B65D 83/26*** | (2006.01) |

(Continued)

(52) U.S. Cl.

CPC ..... *B65D 83/16* (2013.01); *B05B 1/265* (2013.01); *B05B 13/069* (2013.01); *B05B 13/0618* (2013.01); *B05B 13/0627* (2013.01); *B05B 15/045* (2013.01); *B05B 15/0462* (2013.01); *B05D 1/02* (2013.01); *B05D 1/32* (2013.01); *B65D 83/28* (2013.01); *A63B 57/40* (2015.10)

(58) Field of Classification Search

None

See application file for complete search history.

(56) References Cited

U.S. PATENT DOCUMENTS

| | | | |
|---|---|---|---|
| 3,455,728 | A | 7/1969 | Kiwiet |
| 3,737,108 | A | 6/1973 | Stumphauzer et al. |

(Continued)

FOREIGN PATENT DOCUMENTS

| | | |
|---|---|---|
| GB | 355171 | 8/1981 |
| GB | 2206804 A | 1/1989 |

(Continued)

OTHER PUBLICATIONS

GB Examination Report; GB Application No. GB1214905.0, Jun. 15, 2016.

(Continued)

*Primary Examiner* — Binu Thomas

(74) *Attorney, Agent, or Firm* — Thomas J. Oppold; Larkin Hoffman Daly & Lindgren, Ltd.

(57) ABSTRACT

An apparatus includes a container holding a whitening material, and a dispenser to release the whitening material from the container, wherein the dispenser is configured to simultaneously dispense the whitening material in a spray pattern 360 degrees around the dispenser.

12 Claims, 12 Drawing Sheets

(51) Int. Cl.
*B65D 83/28* (2006.01)
*B05B 13/06* (2006.01)

(56) References Cited

U.S. PATENT DOCUMENTS

| | | | | |
|---|---|---|---|---|
| 4,797,305 | A * | 1/1989 | Schleicher | B05B 13/06 118/301 |
| 4,828,182 | A | 5/1989 | Haruch | |
| 5,362,044 | A | 11/1994 | Hageman | |
| 5,382,018 | A | 1/1995 | Browne | |
| 6,455,104 | B1 * | 9/2002 | Kirwan | B05B 13/0636 118/317 |
| 7,033,279 | B2 | 4/2006 | Garske | |
| 2004/0227016 | A1 * | 11/2004 | Yagi | B05B 13/0627 239/486 |
| 2008/0296407 | A1 | 12/2008 | Schleicher | |
| 2012/0024981 | A1 * | 2/2012 | Porter | B05B 13/0618 239/276 |

FOREIGN PATENT DOCUMENTS

| | | | | |
|---|---|---|---|---|
| WO | 2010088284 | A1 | 8/2010 | |
| WO | WO 2010088284 | A1 * | 8/2010 | B05B 13/0618 |
| WO | 2011097039 | A1 | 8/2011 | |
| WO | WO 2011097039 | A1 * | 8/2011 | B05B 1/265 |

OTHER PUBLICATIONS

PCT International Search Report; PCT Application No. PCT/US2011/000228, Aug. 11, 2011.

* cited by examiner

METHOD AND SYSTEM TO WHITEN A GOLF HOLE

CROSS REFERENCE TO RELATED APPLICATIONS

This is a continuation of U.S. application Ser. No. 13/577,593 , filed Aug. 7, 2012 which claims the benefit of PCT Application No. PCT/US2011/000228, filed Feb. 8, 2011, which claims the benefit of U.S. Provisional Application No. 61/302,351 filed Feb. 8, 2010, the specification of which is hereby incorporated by reference in its entirety.

TECHNICAL FIELD

This invention relates to the field of whitening systems, and more specifically to a system to whiten a golf hole.

BACKGROUND

Golf holes are sometimes painted on golf courses. For example, the dirt strip between the grass and the golf cup can be painted by hand by the greenskeeper. This technique is time consuming. Spray paint cans have also been used. But present spray paint cans require the user to manually spin the can around so the paint can be applied to the entire surface.

SUMMARY

An apparatus includes a container holding a whitening material, and a dispenser to release the whitening material from the container, wherein the dispenser is configured to simultaneously dispense the whitening material in a spray pattern 360 degrees around the dispenser.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
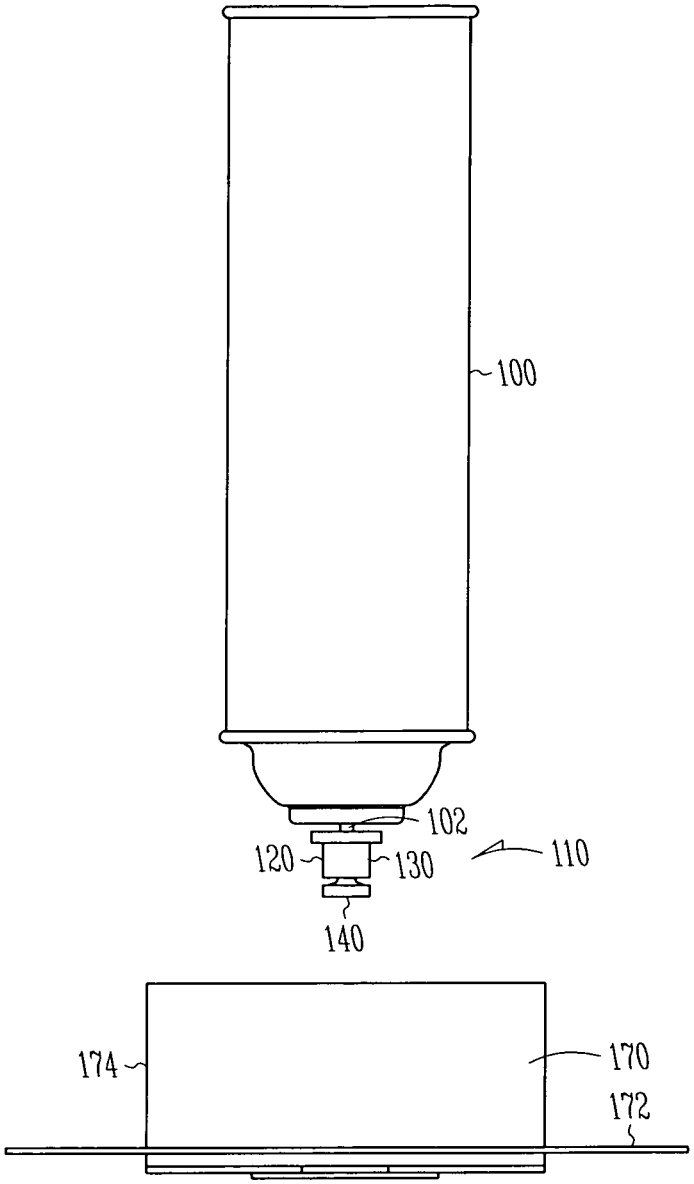
FIG. 1 shows a golf hole whitening system in accordance with one embodiment.

FIG. 1 shows a golf hole whitening system in accordance with one embodiment. The whitening system generally includes a container, such as an aerosol spray paint can 100, holding a whitening material, such as white paint, for whitening the golf hole. The aerosol spray paint can includes a dispenser, such as a valve 110, to release the whitening material from the container. The dispenser is configured to simultaneously dispense the whitening material in a spray pattern 360 degrees around the dispenser.

In this example, the valve 110 is attached to a stem 102 of the spray paint can 100. Valve 110 includes a nozzle 120 which is adapted to direct paint from the aerosol spray paint can in an approximate 180 degree hollow cone spray pattern. A 180 degree hollow cone spray pattern means that the spray angle is approximately 180 degrees (axially) to the nozzle with little or no spray being projected in any direction but perpendicular to the nozzle axis. An activation device 170 can be used to activate the spray paint can. Activation device 170 is placed in the golf hole when used, as will be explained further below.

The 180 degree hollow cone spray pattern provides for the paint (or other whitening material) to come out at all 360 degrees around the nozzle (as viewed from above), but the pattern has a generally 180 degree hollow cone shape as viewed from the side. This 180 degree hollow cone spray pattern is dimensioned to apply paint to about the top 1-2 inches of a golf hole when the nozzle is approximately centered within the golf hole and activated. The 180 degree hollow cone pattern allows the whitening material to be applied without requiring the can to be turned, since the whitening material is applied 360 degrees all around the nozzle. However, in using the present painting system, it is sometimes desirable to turn the spray paint can a quarter turn or so and apply further paint to ensure adequate coverage of the dirt strip.

In this example, nozzle 120 includes a base portion 130 and a diverter portion 140.

Figure 4:
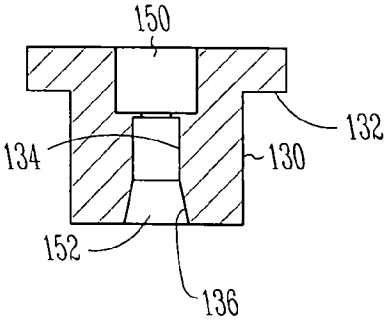
FIG. 4 shows a side cross-section view of the base portion of FIG. 2.
Figure 5:
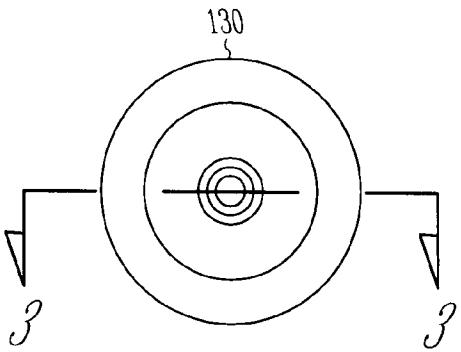
FIG. 5 shows a top view of the base portion of FIG. 2.
Figure 3:
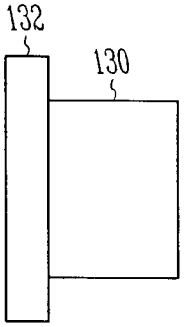
FIG. 3 shows a side view of the base portion of FIG. 2.
Figure 2:
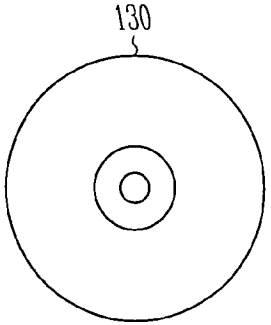
FIG. 2 shows a bottom view of a base portion of a dispenser, in accordance with one embodiment.
Figure 8:
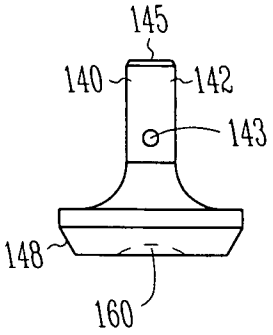
FIG. 8 shows a second side view of the diverter portion of FIG. 6.
Figure 9:
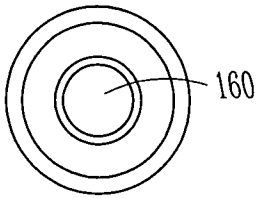
FIG. 9 shows a bottom view of the diverter portion of FIG. 6.
Figure 7:
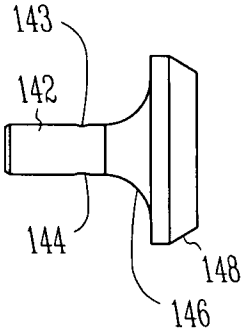
FIG. 7 shows a first side view of the diverter portion of FIG. 6.
Figure 6:
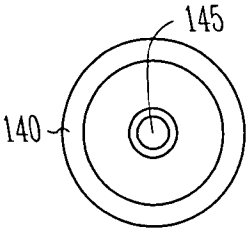
FIG. 6 shows a top view of a diverter portion of a dispenser, in accordance with one embodiment.

FIGS. 2-5 show details of the base portion 130 of nozzle 120, and FIGS. 6-9 show details of diverter portion 140 of nozzle 120, in accordance with one embodiment. FIG. 2 shows a bottom view of the base portion 130; FIG. 3 shows a side view of the base portion; FIG. 4 shows a side cross-section view of the base portion; and FIG. 5 shows a top view of the base portion. FIG. 6 shows a top view of the diverter portion 140; FIG. 7 shows a first side view of the diverter portion; FIG. 8 shows a second side view of the diverter portion; and FIG. 9 shows a bottom view of the diverter portion.

The base portion 130 includes a first opening 150 on a first end to receive a stem of the spray paint can and a second opening 152 on a second end. Opening 152 includes a smaller, first diameter portion 134 to attach to a stem 142 of diverter portion 140. Opening 152 also includes a larger, second diameter portion 136. Second diameter portion 136 is where one or more holes 143, 144 of diverter portion 140 are located when the two pieces are attached. A shoulder 132 is located at the first end of base portion 132. Shoulder 132 is used to activate the spray paint when the shoulder is pressed against the activation device 170 (FIG. 1), as will be discussed below.

Diverter portion 140 includes stem 142 on one end to be received within the second opening 152 of the base portion 130 and a deflector 146 on a second end. The stem 142 includes an opening 145 to receive paint from the spray paint can. The paint travels within the hollow portion of stem 142 and is released through the two or more holes 143, 144. As noted above, stem 142 is positioned within the second opening 152 of the base portion 130 so that the base portion 130 encircles the stem 142 at the location of the two or more holes 143, 144 so that the paint is directed against portion 136 of second opening 152 and then down to the deflector 146. Deflector 146 includes a curved upper surface near the stem and a flatter surface near the outer edge of the deflector. This deflector shape provides for an approximate 180 degree hollow cone spray pattern, as discussed above.

In one embodiment, deflector 146 can include an indentation 160 on a lower surface. Indention 160 can be used with an activator (such as a short stick located within the golf hole) to activate the spray paint can. Deflector 146 can also have outer side walls that have angled or beveled surfaces 148. The beveled surface 148 and indentation 160 can help stop drips from the paint. For example, the beveled surfaces 148 help direct dripping paint toward the indentation 160 where the paint is temporarily collected.

Figure 10:
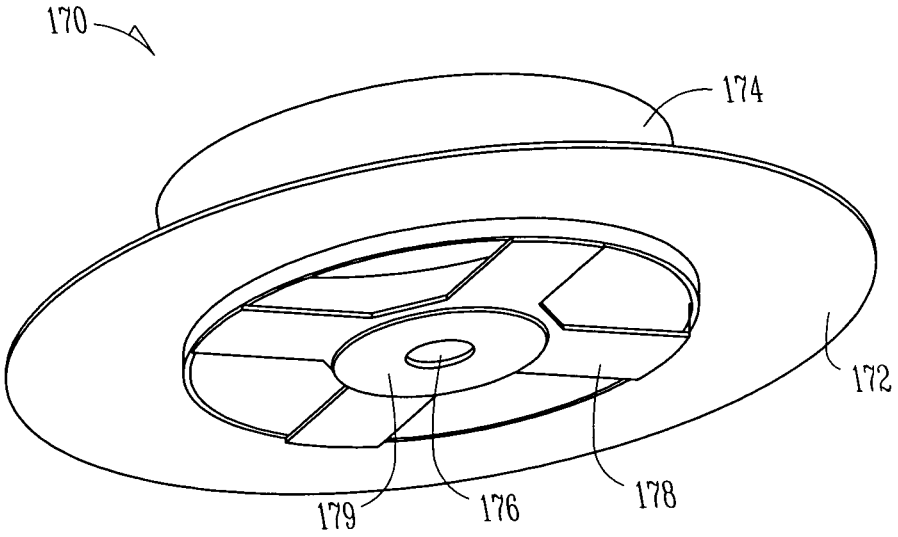
FIG. 10 shows a bottom perspective view of an activation device for a whitening system, in accordance with one embodiment.

FIG. 10 shows a bottom perspective view of the activation device 170 for a whitening system, in accordance with one embodiment. The activation device 170 includes a base surface 172 which rests on and protects the ground and grass around a golf hole from paint splatter, and an upper ring 174. Struts 178 provide support for center activation member 179 which includes a hole 176. Nozzle 120 (FIG. 1) is dimensioned to go through hole 176 so that the shoulder 132 (FIG. 1) is pressed against the central activation member 179 which allows paint to be discharged. Since the nozzle 120 goes through the hole 176, the deflector 146 (FIG. 7) of the nozzle 120 is below the central activation member 179 when the paint is discharged. This configuration allows for the paint to discharge in the 360 degree pattern around the nozzle without any physical structures between the nozzle and the golf hole wall, thus there is no shadowing of the paint pattern as can happen when struts or other structures are between the paint and the golf hole wall. In other words, the paint is allowed to completely cover the golf hole wall and the user does not have to rotate the spray can to completely cover the wall.

Figure 11:
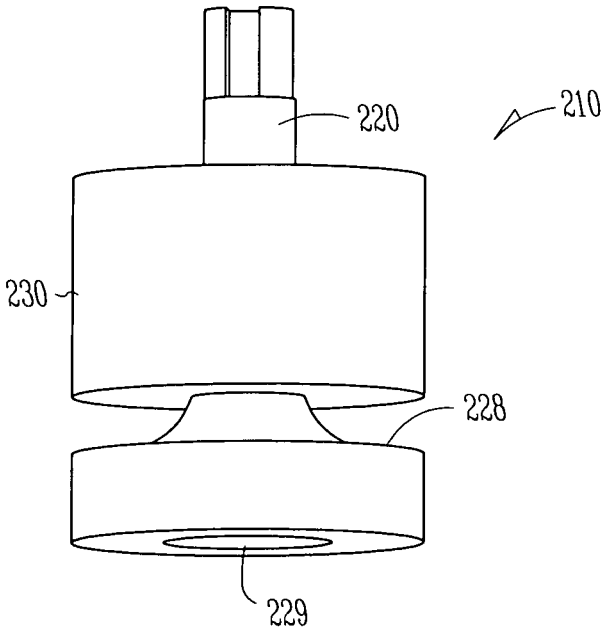
FIG. 11 shows a perspective view of a nozzle, in accordance with one embodiment.

FIG. 11 shows a perspective view of a nozzle 210, in accordance with one embodiment. Nozzle 210 works in a similar matter to nozzle 120 discussed above, but is mounted to the stem of the spray paint can in a male manner instead of a female manner. Nozzle 210 generally includes a base portion 230 and a diverter portion 220. Diverter portion 220 includes a deflector portion 228 and can include an indentation 229 on the bottom surface of the deflector portion 228 when used with a stick-in-the-hole activation device.

Figure 12:
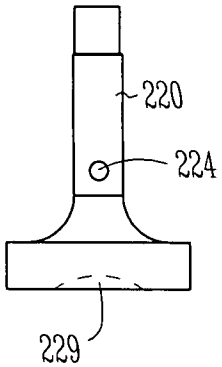
FIG. 12 shows a first side view of a diverter portion of the nozzle of FIG. 11.
Figure 13:
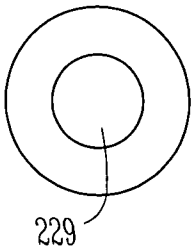
FIG. 13 shows a bottom view of the diverter portion of FIG. 12.
Figure 14:
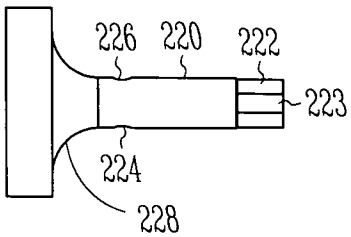
FIG. 14 shows a second side view of the diverter portion of FIG. 12.
Figure 15:
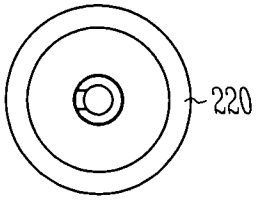
FIG. 15 shows a top view of the diverter portion of FIG. 12.
Figure 16:
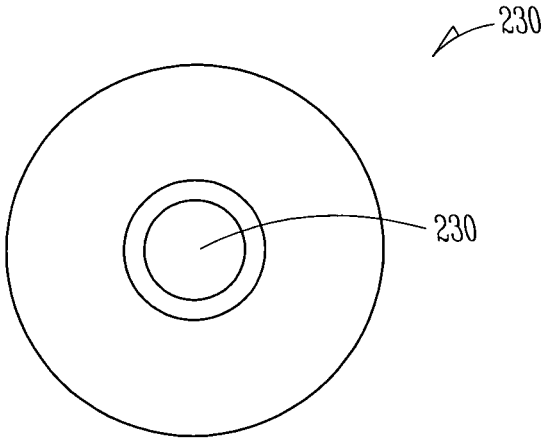
FIG. 16 shows a top view of a base portion of the nozzle of FIG. 11.
Figure 17:
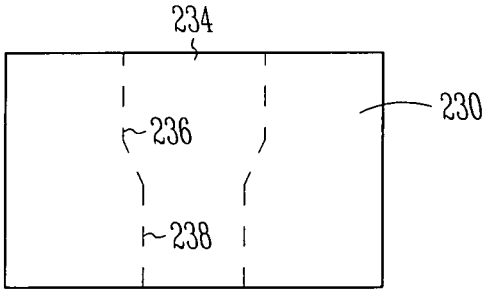
FIG. 17 shows a side view of the base portion of FIG. 16.

FIGS. 12-15 show details of the diverter portion 220, and FIGS. 16-17 show details of base portion 230, in accordance with one embodiment. FIG. 12 shows a first side view of the diverter portion 220; FIG. 13 shows a bottom view of the diverter portion; FIG. 14 shows a second side view of the diverter portion; FIG. 15 shows a top view of the diverter portion; FIG. 16 shows a top view of the base portion 230; and FIG. 17 shows a side view of the base portion.

The diverter portion 220 includes a stem 222 on one end and the deflector 228 on a second end. Stem 222 fits with the stem of the spray paint can and includes an opening 223 to receive paint from the can. The paint travels through stem 222 and is released at two or more holes 224, 226 located along the stem 222.

The base portion 230 includes a central hole 234 having a first, larger diameter portion 236 and a second, smaller diameter portion 238. Base portion 230 is mounted encircling the stem 222 of the diverter portion 220 so that there is a friction fit between the stem 222 and the smaller diameter portion 238 and so that the larger diameter portion 236 is at the location of the two or more holes 224, 226 to direct the paint down to the deflector 228 such that the nozzle directs paint from the aerosol spray paint can in an approximate 180 degree hollow cone spray pattern.

Figure 18:
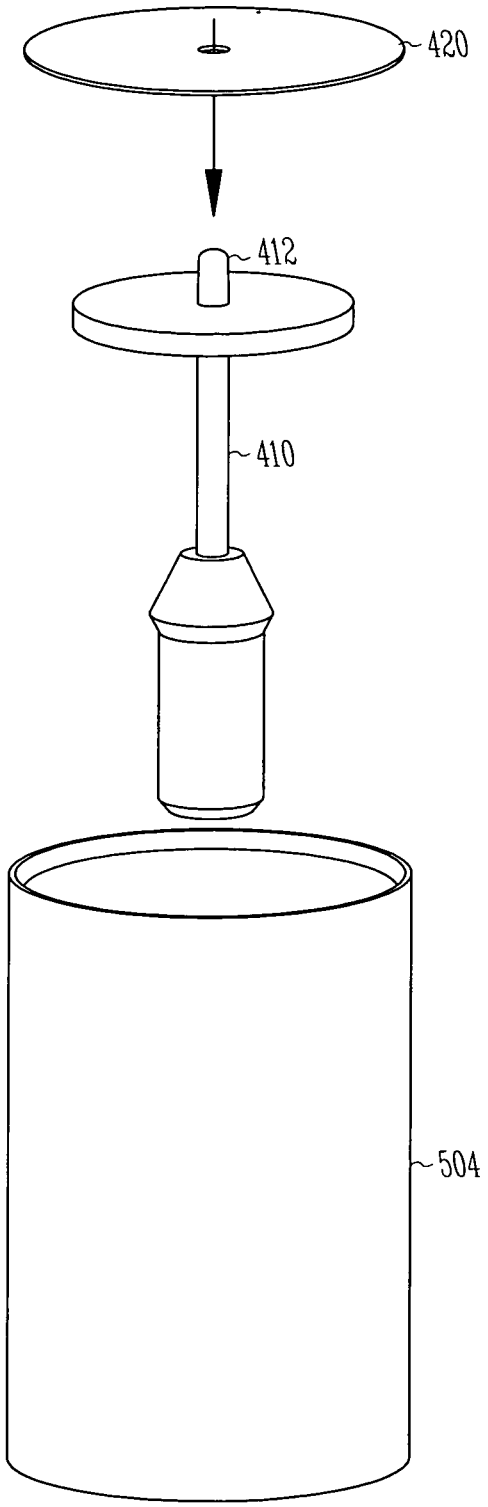
FIG. 18 shows part of a system for whitening a golf hole, in accordance with one embodiment.

FIG. 18 shows part of a system for whitening a golf hole, in accordance with one embodiment. A cup protector 410 includes a nub 412 to receive a shield 420. The cup protector is dropped into the golf cup 504 with the base of the cup protector 410 being received in the flagstick hole and the shield 420 will be at the top of the golf cup 504. The shield 420 protects the cup from getting any whitening material on it when the whitening material is sprayed onto the golf hole walls.

Figure 19:
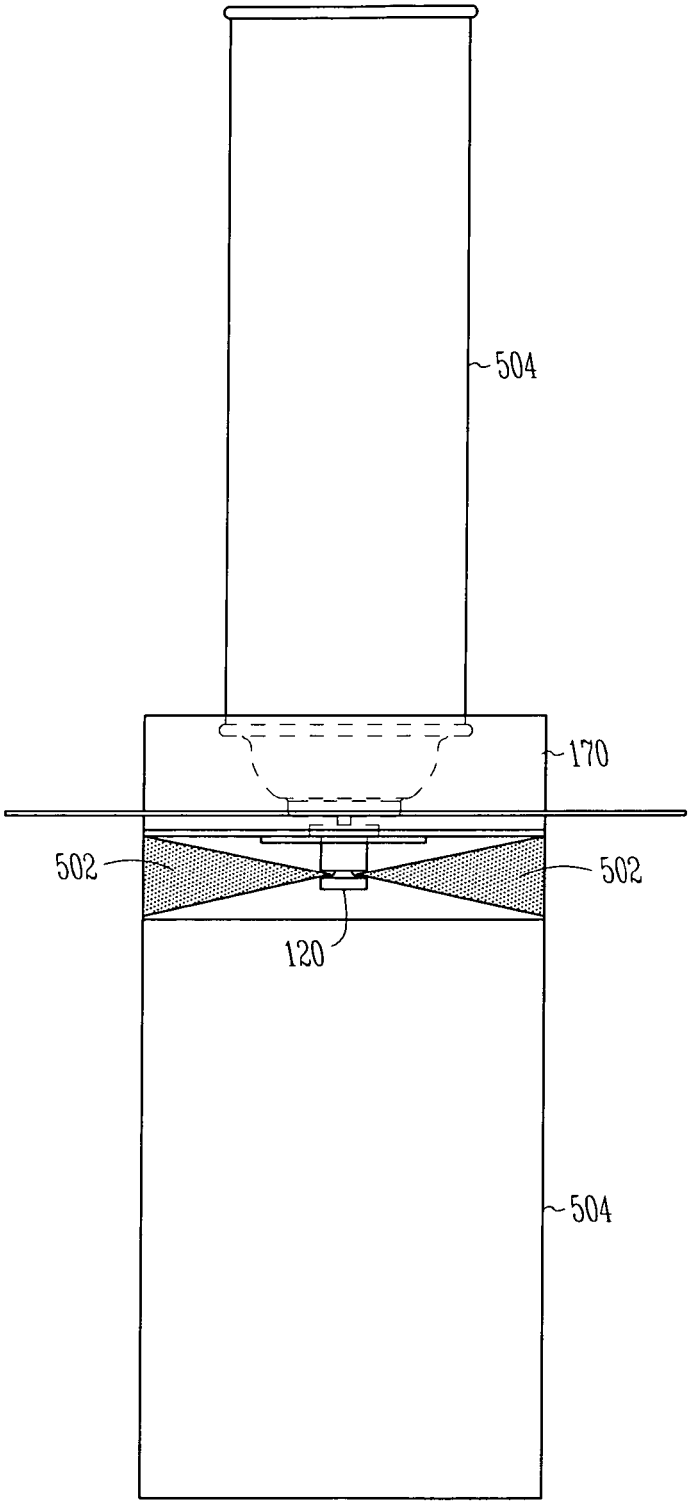
FIG. 19 shows a side view of a golf hole, in accordance with one embodiment.

FIG. 19 shows a side view of a golf hole, in accordance with one embodiment. After the paint shield has been placed, as described above, activation device 170 is placed on the top of the golf hole. The spray paint can 100 is inserted and is activated when the shoulder 132 (FIG. 3) of the nozzle presses against the activation device 170. At that time, the deflector of the nozzle 120 is below the activation device 170 and the paint or other whitener is discharged in a 360 degree pattern (from above). As shown in cross section of FIG. 19, the approximate 180 degree hollow cone spray pattern 502 is dimensioned to only cover the top one inch to two inches or so of dirt above the top of a golf cup 504.

Figure 20:
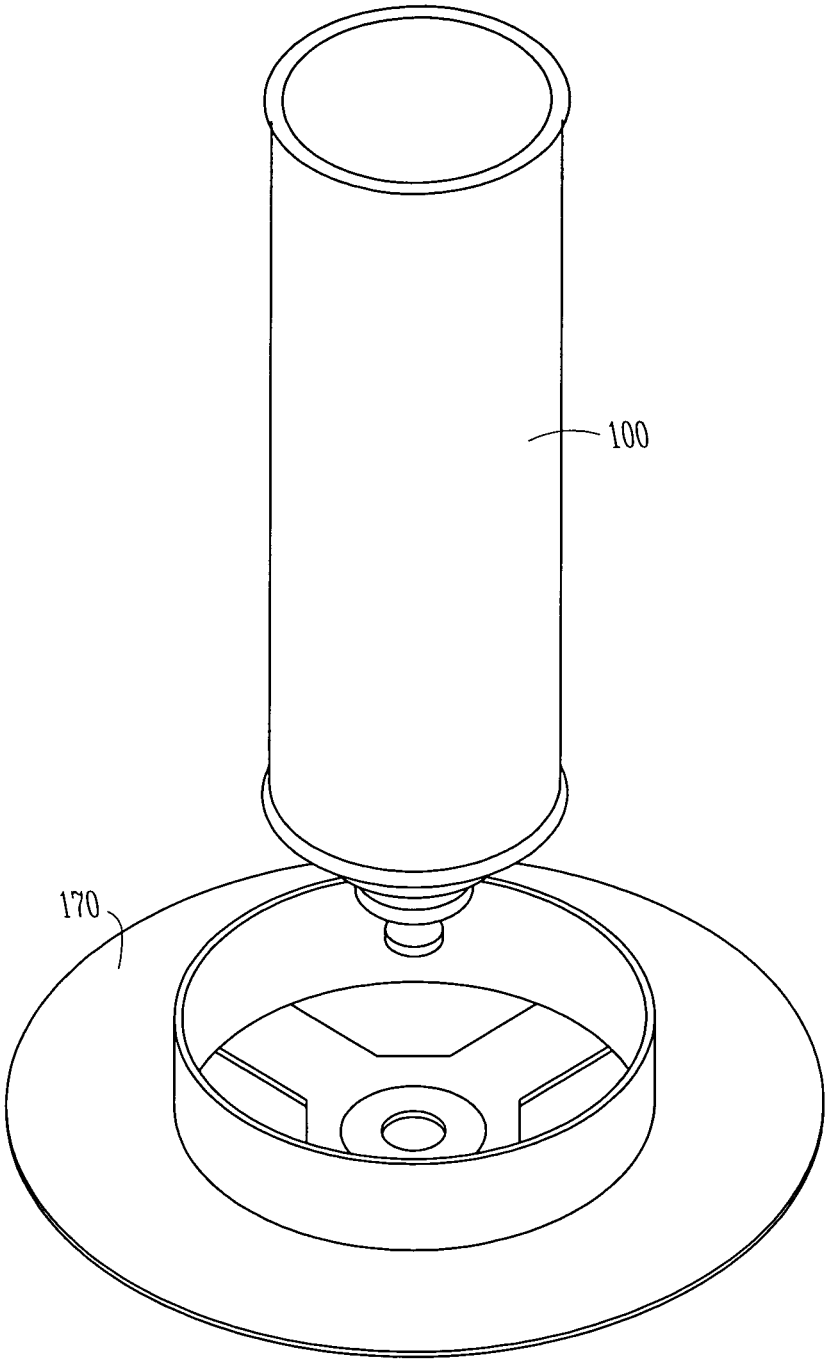
FIG. 20 shows a perspective view of a system for whitening a golf hole, in accordance with one embodiment.

FIG. 20 shows a perspective view of spray paint can 100 and activation device 170, in accordance with one embodiment.

Figure 21:
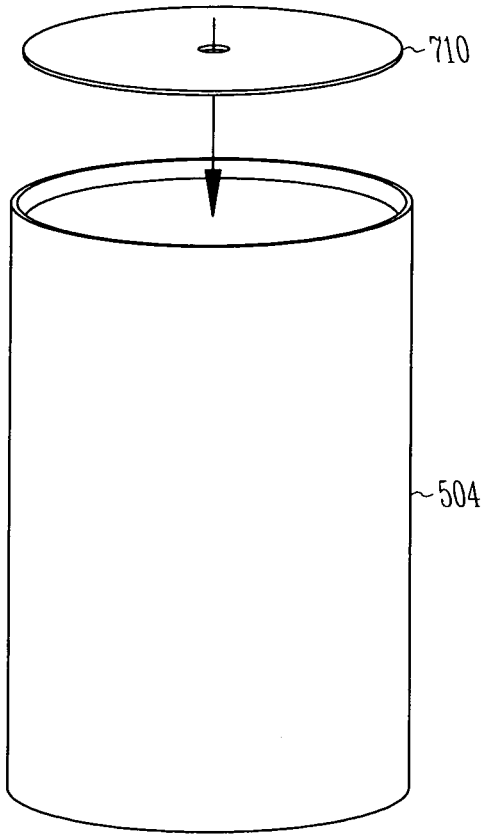
FIG. 21 shows a golf cup shield, in accordance with one embodiment.

FIG. 21 shows a golf cup shield 710, in accordance with one embodiment. In this example, the shield 710 fits just within the top lip of the golf cup 504. In one embodiment, shield 710 can be an aluminum disc.

Figure 22:
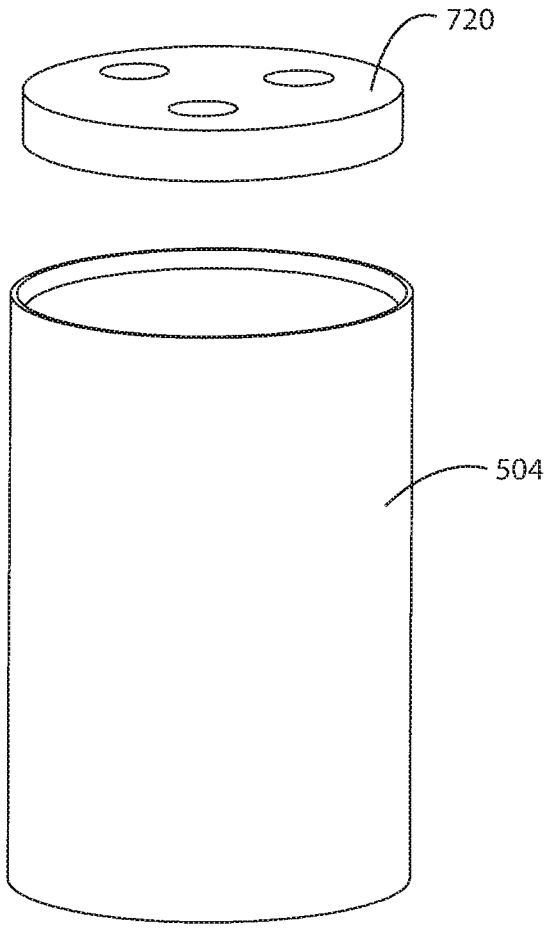
FIG. 22 shows a golf cup shield, in accordance with one embodiment.

FIG. 22 shows a golf cup shield 720, in accordance with one embodiment. In this example, shield 720 is a foam member that is dimensioned to fit within the top of the golf cup 504.

In other embodiments, other activation devices can be utilized. As discussed above, some examples utilize a short stick placed within the golf hole so that the nozzle is pressed against the top of the stick to dispense the whitener. Moreover, other whitener containers can be utilized instead of the spray paint cans discussed above. For example, the whitener can be in a paint can or a jug and the nozzle 120, 210 can be attached to the end of a paint sprayer handle. Also, whiteners other than white paint can be used, such as chalk or white powder.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

The invention claimed is:

1. A system for painting a soil edge above a golf hole cup within a golf hole of a golf green, the system comprising:

in combination:

(a) an aerosol paint container containing paint;

(b) a nozzle attached to the aerosol paint container, which, when axially depressed, causes the paint to be released from the aerosol paint container, the nozzle having:

(i) a stem having a first end and a second end;

(ii) the stem having a shoulder proximate the first end, the shoulder having an outer perimeter;

(iii) the stem having a central bore defining a longitudinal passage extending partially longitudinally into the stem from the first end;

(iv) the stem having a transverse passage in communication with the longitudinal passage; and (v) a deflector disposed at the second end of the stem;

(c) an activator at least partially received in the golf hole, the activator having a base with an opening, the opening sized to receive the deflector therethrough but sized to be less than the outer perimeter of the shoulder;

with the paint container in an inverted position and with the deflector extending through the opening and below the base, the base engages with the shoulder of the nozzle such that with application of an axially downward force on the inverted aerosol paint container, the nozzle is caused to be axially depressed, releasing the paint from the aerosol paint container through the longitudinal passage and out through the transverse passage of the stem, whereupon the paint is deflected by the deflector in a spray pattern toward the soil edge of the golf hole above the golf hole cup.

2. The system of claim 1, wherein an outer periphery of the base is supported on a surface of the golf green and over the golf hole.

3. The system of claim 1 wherein the spray pattern is a 360 degree spray pattern.

4. The system of claim 1 wherein the spray pattern is approximately a 180 degree hollow cone spray pattern.

5. The system of claim 1 wherein the spray pattern is substantially perpendicular to a longitudinal axis of the nozzle.

6. The system of claim 1 further comprising a cup shield sized to be received within the golf hole and to cover the golf cup.

7. A method of applying a dispensable material to a soil edge above a golf hole cup within a golf hole of a golf green, the method comprising:

with an aerosol paint container having a nozzle, the nozzle including:

(i) a stem having a first and a second end;

(ii) the stem having a shoulder proximate the first end, the shoulder having an outer perimeter;

(iii) the stem having a central bore defining a longitudinal passage extending partially longitudinally into the stem from the first end;

(iv) the stem having a transverse passage in communication with the longitudinal passage;

(v) a deflector disposed at the second end of the stem;

(a) disposing an activator at least partially within the golf hole, the activator having a base with an opening, the opening sized to receive the deflector therethrough but sized to be less than the outer perimeter of the shoulder;

(b) inverting the aerosol paint container and inserting the nozzle into the opening of the base of the activator such that the shoulder engages the base and the deflector extends through the opening and below the base;

(c) applying an axially downward force on the inverted aerosol paint container causing the nozzle to be axially depressed, thereby releasing the paint from the aerosol paint container through the longitudinal passage and out through the transverse passage of the stem, whereupon the paint is deflected by the deflector in a spray pattern toward the soil edge of the golf hole above the golf hole cup.

8. The method of claim 7, wherein an outer periphery of the base is supported on a surface of the golf green and over the golf hole.

9. The method of claim 7 wherein the spray pattern is a 360 degree spray pattern.

10. The method of claim 7 wherein the spray pattern is approximately a 180 degree hollow cone spray pattern.

11. The method of claim 7 wherein the spray pattern is substantially perpendicular to a longitudinal axis of the nozzle.

12. The method of claim 7 further comprising:

inserting a cup shield sized to be received within the golf hole and to cover the golf cup prior to disposing the activator at least partially within the golf hole.

* * * * *